US008944219B2

(12) United States Patent
Gerstenkorn

(10) Patent No.: US 8,944,219 B2
(45) Date of Patent: Feb. 3, 2015

(54) CONTROLLING ACCESS TO BUILDING FLOORS SERVICED BY ELEVATORS

(75) Inventor: Bernhard Gerstenkorn, Ebikon (CH)

(73) Assignee: Inventio AG, Hergiswil NW (CH)

( * ) Notice: Subject to any disclaimer, the term of this patent is extended or adjusted under 35 U.S.C. 154(b) by 618 days.

(21) Appl. No.: 13/265,768

(22) PCT Filed: Apr. 21, 2010

(86) PCT No.: PCT/EP2010/055234

§ 371 (c)(1),
(2), (4) Date: Oct. 21, 2011

(87) PCT Pub. No.: WO2010/122040

PCT Pub. Date: Oct. 28, 2010

(65) Prior Publication Data

US 2012/0037458 A1 Feb. 16, 2012

(30) Foreign Application Priority Data

Apr. 24, 2009 (EP) ..... 09158678

(51) Int. Cl.
*B66B 1/20* (2006.01)
*B66B 1/46* (2006.01)

(52) U.S. Cl.
CPC ..... *B66B 1/468* (2013.01); *B66B 2201/4615* (2013.01); *B66B 2201/463* (2013.01); *B66B 2201/4638* (2013.01); *B66B 2201/4676* (2013.01)
USPC ..... 187/384; 187/392

(58) Field of Classification Search
CPC ..... B66B 2201/463; B66B 2201/4638; B66B 2201/4676; B66B 2201/4615
USPC ..... 187/247, 380–388, 391–393
See application file for complete search history.

(56) References Cited

U.S. PATENT DOCUMENTS

| | | | | |
|---|---|---|---|---|
| 6,707,374 | B1 * | 3/2004 | Zaharia | 340/5.31 |
| 7,190,256 | B2 * | 3/2007 | Pieper | 340/5.7 |
| 7,581,622 | B2 * | 9/2009 | Amano | 187/384 |
| 8,061,485 | B2 * | 11/2011 | Finschi | 187/384 |
| 8,151,943 | B2 * | 4/2012 | de Groot | 187/382 |
| 8,381,880 | B2 * | 2/2013 | Finschi | 187/388 |
| 8,464,840 | B2 * | 6/2013 | Flynn et al. | 187/384 |
| 8,490,754 | B2 * | 7/2013 | Amano | 187/384 |
| 8,684,142 | B2 * | 4/2014 | Finschi | 187/392 |
| 2012/0241259 | A1 * | 9/2012 | Flynn et al. | 187/384 |

* cited by examiner

*Primary Examiner* — Anthony Salata
(74) *Attorney, Agent, or Firm* — Stroock & Stroock & Lavan LLP

(57) ABSTRACT

A person is detected before entering an elevator in a building, and a destination floor desired by the person is detected. When the person leaves the elevator, the floor on which the person leaves the elevator is detected using a further detecting device. An action is triggered if the floor on which the person leaves the elevator and the destination floor do not match.

20 Claims, 2 Drawing Sheets

1 BUILDING
2 ELEVATOR
3 CAR
4 DRIVE
5 CONTROLLER
6-12 DETECTION DEVICE
15-21 DESTINATION CALL KEYPAD
SW0 – SW6 FLOOR

CONTROLLING ACCESS TO BUILDING FLOORS SERVICED BY ELEVATORS

FIELD

The disclosure relates to location-dependent management of persons.

BACKGROUND

The document WO 2007/014477 discloses a method for guiding a passenger to an elevator car of an elevator system in a building. For this purpose, the passenger on a starting floor uses a mobile communication unit to deliver a destination call to a destination call control unit of the elevator system. The destination call control unit determines a group of elevator cars for handling the destination call and transmits this group to the mobile communication unit. The passenger uses the mobile communication unit to select an elevator car and transmits this selection to the destination call control unit. The destination call control unit then transmits the information for guiding the passenger to the selected elevator car on the starting floor. However, this method does not make it possible to determine the whereabouts of the passenger without the passenger himself actively informing the system of his location.

In addition, the document EP 1 433 735 A1 discloses a method for evacuating persons in a building in an emergency. For this purpose, the number of persons in the building is measured and it is detected whether an emergency occurs in the building. This method also does not make it possible to determine the whereabouts of the persons.

SUMMARY

Some embodiments comprise a method for location-dependent management of persons in a building, which method can be used to determine the whereabouts of a person in the building without, for example, the person himself having to contribute anything.

Some embodiments make it possible to reduce the number of journeys with an elevator in which a person has not stated a destination floor but rather is using the elevator together with another person.

Particular embodiments of a method for location-dependent management of persons in a building comprise the following steps. A detection device is used to detect the person before entering an elevator present in the building. The destination floor selected by the person is also detected. When the person leaves the elevator again, the floor on which he leaves the elevator again is detected using a further detection device. A control device is used to trigger an action if this floor and the destination floor do not match.

In one embodiment of the method, the action may thus result in the person being deprived of the authorization to access the elevator.

Alternatively or additionally, the action may also result in the person being issued with a message, for example in the form of an SMS or an e-mail, in which the person is advised of the discrepancy.

In addition, the action may also result in the person being provided with an elevator car so that the person reaches the destination floor ZSW.

The action may also result in the person only being entitled to travel downward with the elevator, possibly to the lobby.

Which action is initiated can be made dependent on the status of the person. For example, an elevator installer entrusted with maintenance work can be assigned a special status.

In addition, the action can also be made dependent on the time at which the mismatch between the destination floor and the floor on which the person left the elevator is detected. For example, the detection of the whereabouts of the person can be restricted to the usual business or office hours.

The action can also be made dependent on the location of the person.

Irrespective of the action initiated, the information relating to the whereabouts of the person can be taken into account in an emergency plan.

BRIEF DESCRIPTION OF THE DRAWINGS

The disclosure is explained further below using two figures.

DETAILED DESCRIPTION

Figure 1:
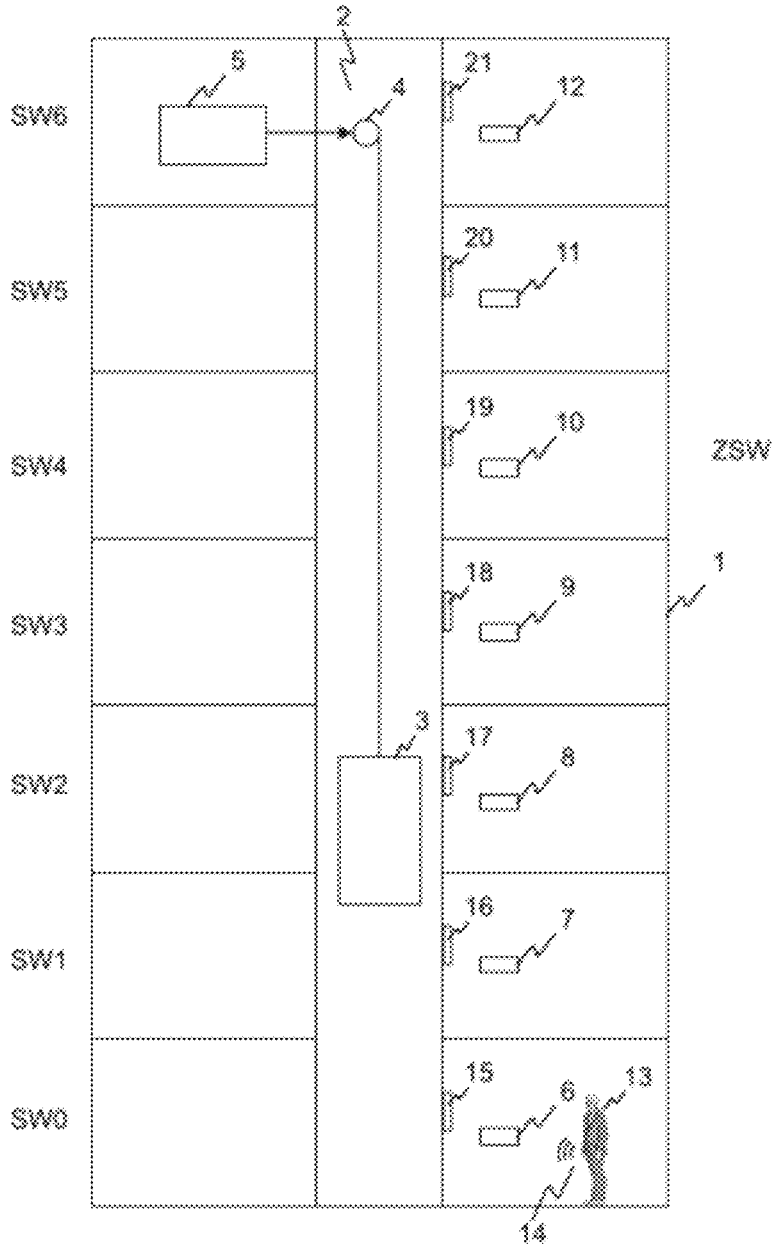
FIG. 1 shows the side view of a building having an elevator, an exemplary embodiment of the disclosed technologies being used in the building.

FIG. 1 illustrates the side view of a building 1 having an elevator 2 in section. The building comprises seven floors SW0 to SW6, the entrance to the building 1 being on the floor SW0. The elevator 2 comprises a car 3 which is moved via a drive 4. The drive 4 is controlled with the aid of a controller 5. A respective detection device 6 to 12 is provided on each of the floors SW0 to SW6 in order to detect the position of the identification element 14 carried by a person 13. For example, the detection device 11 is used to detect whether and, if appropriate, when the person 13 is on the floor SW5. The detection devices 6 to 12 may be placed on the wall in the vicinity of the elevator or else on doors or passageways.

The identification element 14 possibly operates in a contactless manner, for example using radio. The identification element 14 may be, for example, a contact-type chip card or else a contactless chip card. The latter may have an RFID (Radio Frequency Identification) tag and can be connected to the corresponding detection device 6, 7, 8, 9, 10, 11 and 12 via a radio link. However, the identification element 14 may also be a mobile telephone carried by the person 13. In this case, the mobile telephone and the detection devices 6-12 may be connected via Bluetooth or WIFI (Wireless Fidelity), for example.

A destination call keypad 15 to 21 which can be used by the person 13 to input the desired destination floor ZSW is also respectively provided on each of the floors SW0 to SW6.

Like the detection devices 6 to 12, the destination call keypads 15 to 21 are connected to a controller 5. The controller 5 may also be simultaneously the controller for the elevator 2.

For simplicity and better understanding, the following explanations are based on an individual person 13. However, it goes without saying of course that the method according to the disclosed technologies is suitable for managing or dealing with a multiplicity of persons.

Figure 2:
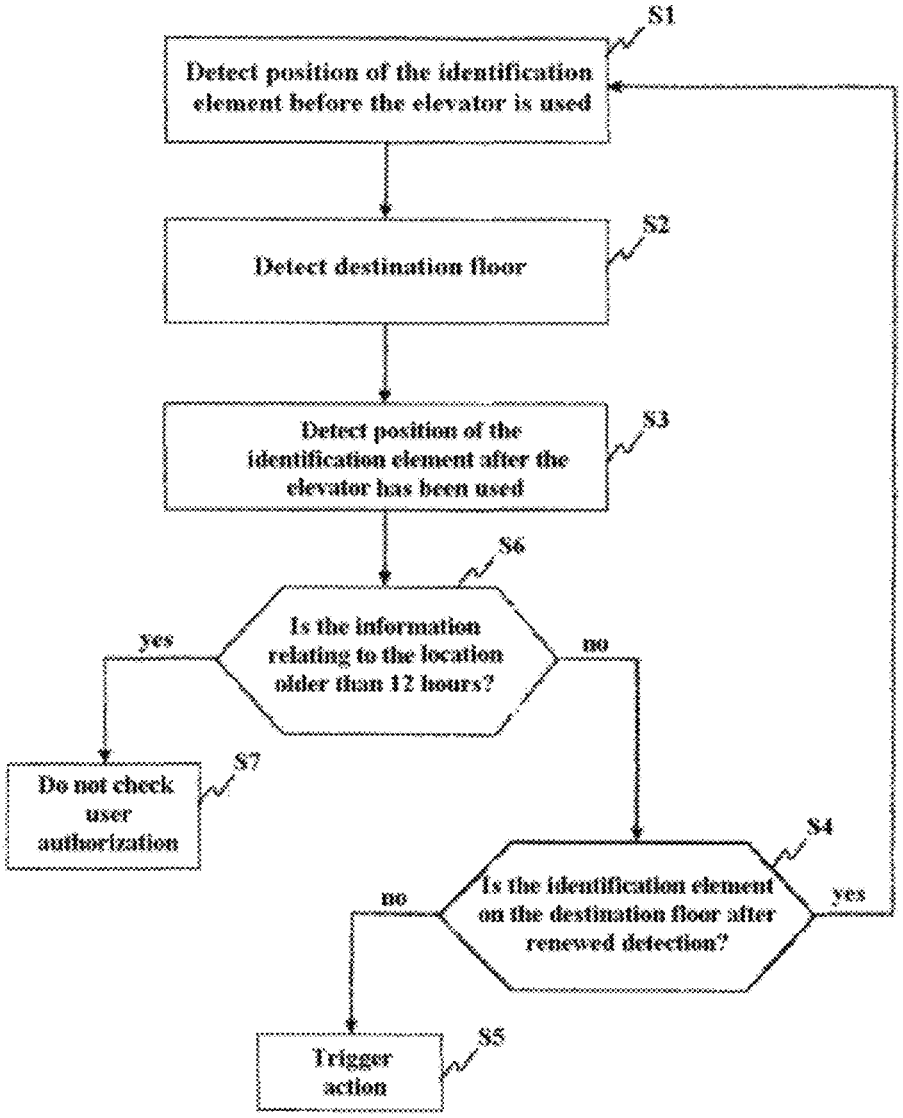
FIG. 2 shows one possible embodiment of the disclosed method in the form of a block diagram.

Embodiments of the method are explained further by way of example below using the two FIGS. 1 and 2. As soon as the person 13 carrying the identification element 14 enters the building 1 and passes into the detection range of the detection device 6, a radio link is set up between the detection device 6 and the identification element 14 and the identification code stored on the identification element 14 is transmitted to the detection device 6 (FIG. 2, step S1). The detection device 6 forwards the identification code to the controller 5. In this manner, the controller 5 now knows that the person 13 is on the floor SW0 and since when. If the person 13 now calls the elevator 2 with the aid of a destination call controller 15 by inputting the desired destination floor ZSW (the floor SW4 in the present example) on the keypad of the destination call controller, the information relating to the desired destination floor ZSW is likewise transmitted to the controller 5 by the destination call keypad 15 (FIG. 2, step S2). The controller 5 thus knows the floor on which the person 13 is currently situated, namely the floor SW0, and also his destination floor, namely the destination floor ZSW=SW4.

If the person 13 does not leave the elevator 2 on the destination floor ZSW=SW4, but rather already before said floor, for example on the floor SW1, this is detected by the detection device 7 as soon as the person 13 passes into the detection range of the detection device 7 (FIG. 2, step S3). A radio link is set up between the detection device 7 and the identification element 14 and the identification code stored on the identification element 14 is transmitted to the detection device 7. The detection device 7 forwards the identification code to the controller 5. The controller 5 now checks whether the floor on which the person 13 was detected matches the destination floor ZSW (FIG. 2, step S4). Since this is not the case in the present example, the controller 5 can now trigger a particular action (FIG. 2, step S5).

The action may result, for example, in the person 13 being deprived of the authorization to access the elevator 2. The person 13 must then report to the reception staff, for example, and must again acquire authorization to use the elevator there.

Alternatively or additionally, the action may also result in the person 13 being issued with a message in the form of an SMS or an e-mail in which the person is advised of the discrepancy.

Additionally or alternatively, a message may also be sent to the reception staff so that the latter knows that the person 13 is possibly still in the building.

In addition, the action may also result in the person 13 being provided with the elevator car 3 so that the person reaches the destination floor ZSW.

The action may also result in the person 13 only being entitled to travel downward with the elevator 2, possibly to the floor SW0.

If the person 13 was not detected by the detection device 6 as early as in the entrance area of the building but was only detected on one of the floors SW1 to SW6, the person 13 may also be denied use of the elevator in principle.

A bonus system may also be provided in order to avoid inadvertently triggered sanctioning actions. The bonus system may be useful if, for example, the database used by the controller 5 does not yet contain any entries and only gradually receives new entries. For this purpose, a somewhat higher bonus may be initially provided and is then reduced over the course of time.

The situation may occur in which the bonus value is changed in the database and is set to a particular value B1 for reasons which are not caused by the behavior of the person 13. If, at the time at which the person 13 is detected, the entry belonging to this person in the database has a bonus value which is lower than the bonus value B1, the controller 5 does not initiate an action, that is to say the use authorization is not checked. As a result, inadvertently triggered sanctioning actions with respect to the person 13 can be avoided.

Which action is initiated can be made dependent on the status of the person 13. In addition, the action can also be made dependent on the time at which the mismatch between the destination floor ZSW and the floor on which the person 13 left the elevator is detected. The action can also be made dependent on the location of the person 13.

However, if the person 13 actually gets out on the destination floor (ZSW=SW4 in the example), the controller 5 does not carry out any of the abovementioned actions.

In addition, the controller 5 can check how old the last item of information relating to the whereabouts of the person 13 is (FIG. 2, step S6). If this information is older than 12 hours for example, the authorization of the person to use the elevator 3 is not checked (FIG. 2, step S7). This may be important when the person is not in the building for a relatively long time, for example on account of a vacation.

Irrespective of the action initiated, the information relating to the whereabouts of the person 13 may be taken into account in an emergency plan. This information may be useful, in particular, when evacuating the building 1.

Instead of inputting the desired destination floor ZSW via the destination call keypad 15-21, provision may also be made for the destination floor which is generally desired to be stored on the identification element 14 and for the detection device 6 to also detect the information relating to the desired destination floor.

If desired, embodiments of the disclosed method can also be used only for one part or section of the building 1. In this case, it is useful to respectively provide a detection device 6 both in the entrance area and in the exit area. The controller 5 ensures that the database then stores whether the person 13 has entered or left the building section provided with the method for managing persons.

Having illustrated and described the principles of the disclosed technologies, it will be apparent to those skilled in the art that the disclosed embodiments can be modified in arrangement and detail without departing from such principles. For example, it is not necessarily important how many floors the building has in which the disclosed technologies are used. In addition, the method can also be used in a building having a plurality of elevators. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

The invention claimed is:

1. A method for location-dependent management of persons in a building, the method comprising steps:

in which a detection device is used to detect a person before entering an elevator present in the building, in which a destination floor desired by the person is detected, in which a further detection device is used to detect a floor on which the person leaves the elevator, in which a control device is used to trigger an action if the floor on which the person leaves the elevator and the destination floor do not match, wherein the action results in the person only being entitled to travel downward with the elevator, or wherein the action results in the person being provided with an elevator car so that the person reaches the destination floor.

2. The method of claim 1, in which information relating to whereabouts of the person is taken into account in an emergency plan.

3. The method of claim 1, in which the action further results in the person being sent a message.

4. The method of claim 1, in which the action is made dependent on a status of the person.

5. The method of claim 1, in which the action is made dependent on a time at which the mismatch was determined.

6. The method of claim 1, in which the action is made dependent on a location of the person.

7. The method of claim 1, in which the detection device detects whereabouts of the person using a contactlessly operating identification element carried by the person.

8. The method of claim 1, in which the person is assigned a bonus, and in which the bonus is changed on the basis of behavior of the person and the action is further dependent on the bonus.

9. A method comprising:

detecting a location of a person outside of an elevator car of an elevator installation;

transporting the person in the elevator car to a floor in a building served by the elevator installation;

detecting that the person has exited the elevator car at the floor;

determining that the floor at which the person exited the elevator car is not a previously indicated destination floor for the person; and as a result of the determining, limiting the person's use of the elevator installation to traveling to a lobby in the building or to traveling to the previously indicated destination floor.

10. The method of claim 9, the limiting the person's use of the elevator installation being further a result of determining a status of the person.

11. An elevator system controller comprising:

a computer; and a computer-readable storage medium having encoded thereon instructions that, when executed by the computer, cause the computer to perform a method, the method comprising, detecting a location of a person outside of an elevator car of an elevator installation, transporting the person in the elevator car to a floor in a building served by the elevator installation, detecting that the person has exited the elevator car at the floor, determining that the floor at which the person exited the elevator car is not a previously indicated destination floor for the person, and as a result of the determining, limiting the person's use of the elevator installation to traveling to a lobby in the building, or to traveling to the previously indicated destination floor.

12. An elevator installation comprising:

an elevator car disposed in a shaft; and an elevator system controller, the elevator system controller being configured to, detect a location of a person outside of the elevator car, transport the person in the elevator car to a floor in a building served by the elevator installation, detect that the person has exited the elevator car at the floor, determine that the floor at which the person exited the elevator car is not a previously indicated destination floor for the person, and as a result of the determining, limit the person's use of the elevator installation to traveling to a lobby in the building or to traveling to the previously indicated destination floor.

13. A non-transitory computer-readable medium containing computer program code that, when read by a computer, causes the computer to perform a method, the method comprising:

detecting a location of a person outside of an elevator car of an elevator installation;

transporting the person in the elevator car to a floor in a building served by the elevator installation;

detecting that the person has exited the elevator car at the floor;

determining that the floor at which the person exited the elevator car is not a previously indicated destination floor for the person; and as a result of the determining, limiting the persons use of the elevator installation to traveling to a lobby in the building or to traveling to the previously indicated destination floor.

14. A method comprising:

detecting a person on a first floor of a building using a detection device;

determining that the person was not previously detected as being on a second floor of the building, the first and second floors being served by an elevator installation; and as a result of the determining, triggering an action for the person.

15. The method of claim 14, the triggering the action for the person comprising limiting the persons use of the elevator installation.

16. The method of claim 15, the limiting the person's use of the elevator installation comprising allowing the person to travel to only the second floor using the elevator installation.

17. The method of claim 15, the limiting the person's use of the elevator installation comprising requiring the person to contact a security department before further using the elevator installation.

18. The method of claim 14, the triggering the action for the person comprising sending a message to the person.

19. The method of claim 14, the triggering the action for the person comprising notifying a security system.

20. The method of claim 14, the second floor of the building comprising a building lobby.

* * * * *